US005809898A

United States Patent [19]

Kaufhold et al.

[11] Patent Number: 5,809,898

[45] Date of Patent: Sep. 22, 1998

[54] RING SEAT REMOVAL SYSTEM FOR A RAILCAR ARTICULATE CONNECTOR

[75] Inventors: Horst T. Kaufhold; John J. Steffen, both of Aurora, Ill.

[73] Assignee: Amsted Industries Incorporated, Chicago, Ill.

[21] Appl. No.: 792,808

[22] Filed: Jan. 30, 1997

[51] Int. Cl.[6] ..... B61D 49/00

[52] U.S. Cl. ..... 105/4.1; 105/3; 384/510

[58] Field of Search ..... 105/3, 4.1, 4.2, 105/4.3; 213/75 R; 384/510, 559, 561, 600; 29/498.06, 426.5

[56] References Cited

U.S. PATENT DOCUMENTS

| | | | |
|---|---|---|---|
| 1,980,156 | 11/1934 | Emrick | 62/1 |
| 2,348,293 | 7/1944 | Hamer | 308/237 |
| 3,716,146 | 2/1973 | Altherr | 213/75 R |
| 3,721,482 | 3/1973 | Tack et al. | 308/72 |
| 4,258,628 | 3/1981 | Altherr | 105/4 R |
| 4,336,758 | 6/1982 | Radwill | 105/4 R |
| 4,593,829 | 6/1986 | Radwill | 213/75 R |
| 4,867,071 | 9/1989 | Weber | 105/4.1 |
| 5,014,626 | 5/1991 | Schultz | 105/4.1 |

*Primary Examiner*—Mark Tuan Le

*Attorney, Agent, or Firm*—Edward J. Brosius; F. S. Gregorczyk; Stephen J. Manich

[57] ABSTRACT

An improved female connecting member for an articulated connector has a ring seat for a ring within an annular groove for contacting the male member of the connector, which female member has an improved undersurface passage for a probe to provide greater access to the ring-seat undersurface and more mechanical leverage to dislodge a worn ring seat; and, in an alternative embodiment, a structure and tool are provided for removal of a ring-seat from the exposed upper ring-seat surface.

4 Claims, 4 Drawing Sheets

RING SEAT REMOVAL SYSTEM FOR A RAILCAR ARTICULATE CONNECTOR

BACKGROUND OF THE INVENTION

The present invention relates to the repair of articulated connectors for railcars. More specifically, a female member of an articulated connector is illustrated and a method is taught to facilitate removal of a spherical ring seat from the female connecting member.

Articulated connectors with male and female connecting members joining adjacent ends of railcars on the bolster of a single truck to form a semi-permanent unit is well known, which is illustrated in the following United States patents: U.S. Pat. No. 3,721,482 to Tack et al.; U.S. Pat. No. 3,716,146 to Altherr; U.S. Pat. No. 4,336,758 to Radwill; and, U.S. Pat. No. 4,258,628 to Altherr.

The female connecting or coupling members of articulated connectors can include an annular groove for a spherical ring and ring seat, which act as a support surface for the male connecting member. The spherical ring and ring seat allow, in part, for vertical and horizontal angling movement as well as rotational movement between the male and female connecting members when their respective railcars are travelling on grades, around curves or rocking with respect to each other.

The abutting relationship of such connecting parts under high loads requires the maintenance of close tolerances to prevent high impact forces, which can cause excessive wear and possible fracture within the connection. During extended periods of service, the spherical ring and ring seat, as well as their respective opposed surfaces, wear. This wear lowers the male connecting member and its coupled car body. As a consequence, a corresponding decrease in the restrictive space allocated for side bearing clearance is experienced. The reduced clearance is below the minimum height set by the American Association of Railroads (AAR). Restoration of the male connector to an acceptable height may be accommodated by placement of a shim within the angular groove under the spherical ring seat. In this case, the male connecting member is disconnected from the female connecting member; the spherical ring and ring seat are withdrawn from the annular groove; a shim of the correct thickness is nested in the base of the groove; the worn ring and ring seat are inserted atop the shim; and, the male member is again mated with the female member to form the articulated connector.

Implementing the above-noted maintenance procedure has encountered difficulties with removal of the worn spherical ring seat as the seat often becomes lodged within the annular groove from such circumstances as entrapped grit, dirt or other debris, or from wear into the groove seat. This entrapment is a severe impediment to disassembly and repair of the connector and subsequent reinsertion into service of the associated railcar. If the spherical ring seat cannot be removed during the repair procedure, it must be cut into several pieces or otherwise destroyed to effect its removal. This requires premature replacement of the spherical ring seat at an added expense to the railcar owner. Thus, it is desirable to remove the spherical ring seat without inflicting any mechanical damage to the spherical ring seat or annular groove.

U.S. Pat. No. 5,014,626 to Schultz provide an access port to the lower surface of the spherical ring seat, however, the structure and position of the disclosed arrangement presented certain undesirable inhibitions to ready access and mechanical leverage to dislodge the spherical ring seat.

Consequently, efforts have continued to enhance the ease of spherical ring seat removal.

SUMMARY OF THE INVENTION

The present invention provides an improved access port structure, and it discloses an easier methodology to effect the spherical ring seat removal by improved mechanical advantage between the removal tool and access-port structure.

This arrangement provides probing access to the base of the spherical ring seat with displacement of the wedge or tool; the floor of the access-port is operable as the locating arm for the tool without groping for a secondary internal port; and finally the outer edge of the access-port, which is the outer surface of the female connecting member, is operable as a fulcrum-like arrangement for a lever-arm wedge or probe.

In the alternative embodiment of the present invention, a structure, method and apparatus are taught and illustrated to provide an uniform mechanical force to the ring seat for its removal from the annular groove without potential sharp or shock forces being applied to the ring seat.

BRIEF DESCRIPTION OF THE DRAWING

In the Figures of the Drawing, like reference numerals identify like components and in the Drawing.

DESCRIPTION OF THE PREFERRED EMBODIMENT

Figure 1:
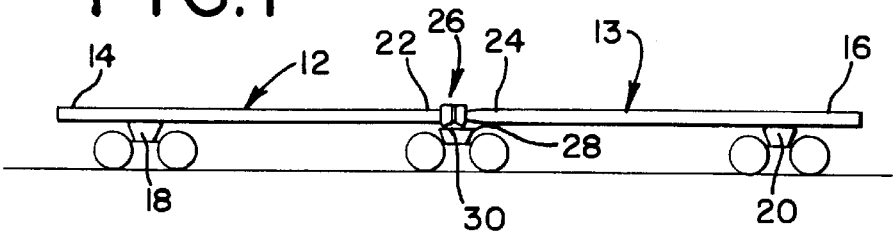
FIG. 1 is a diagrammatic side view of two railcars connected by an articulated connector, which is supported by a single truck to form a coupling unit.

In FIG. 1, first railcar body 12 with unattached end 14 and second railcar body 13 with second unattached end 16, which unattached ends 14 and 16 are supported by conventional railcar trucks 18 and 20, respectively, as known in the art. Inner end 22 of first railcar 12 is coupled to inner end 24 of second railcar body 13 by articulated connector 26, which is carried on bolster 28 of a single railcar truck 30 to form a unit assembly. It is understood that more than two railcar bodies may be joined to form an unit.

Figure 2:
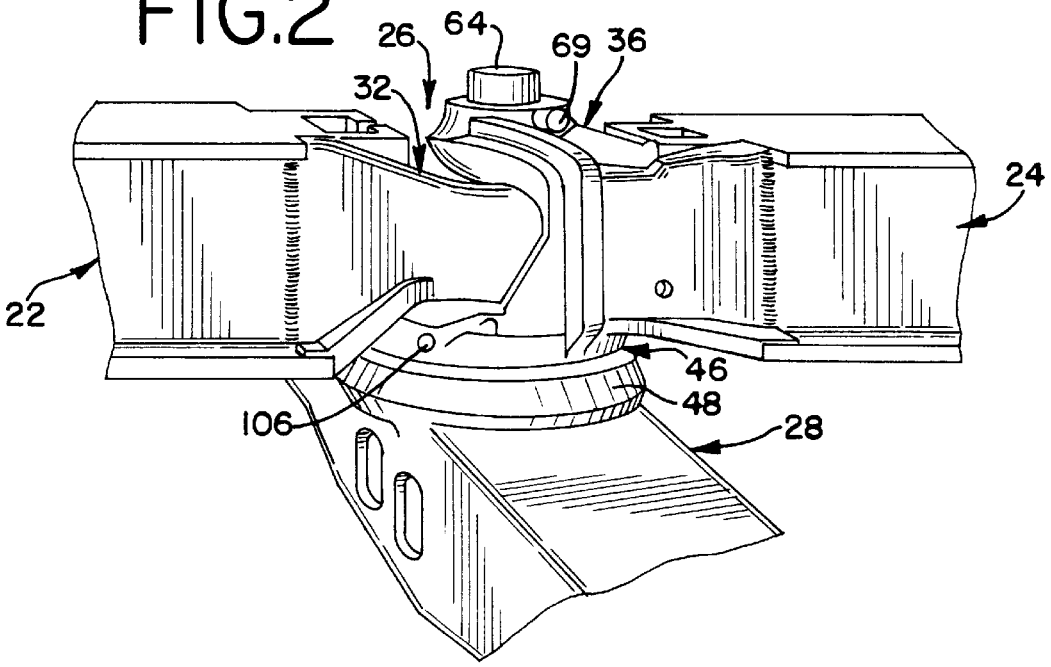
FIG. 2 is a perspective view of an articulated connector with a ring-seat access port.
Figure 3:
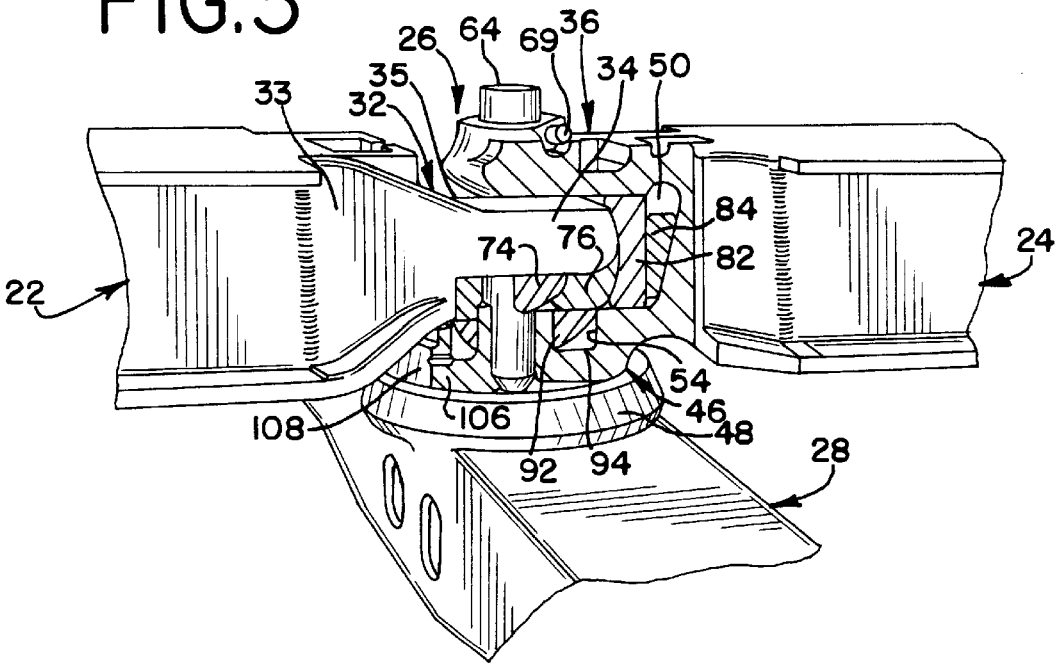
FIG. 3 is a perspective view of the articulated connector in FIG. 2 in partial section.
Figure 4:
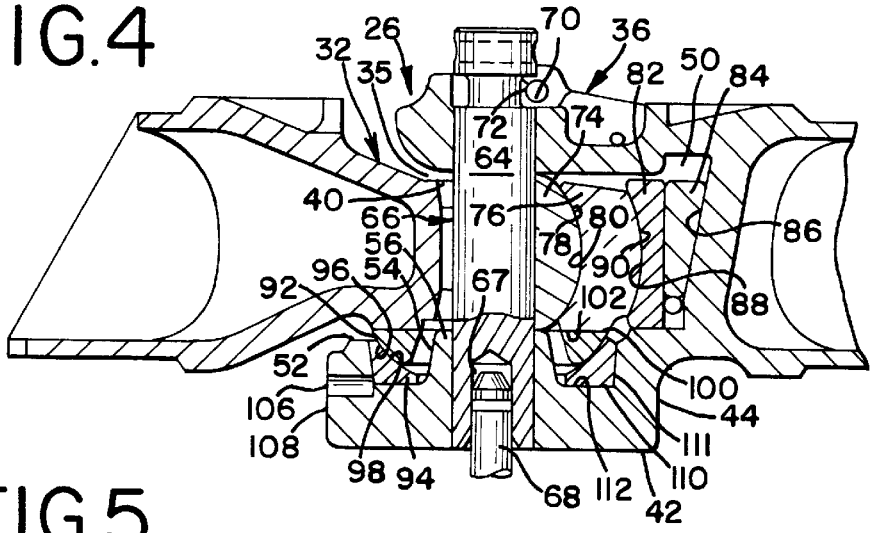
FIG. 4 is a side elevational view in section of the articulated connector in FIG. 2.
Figure 5:
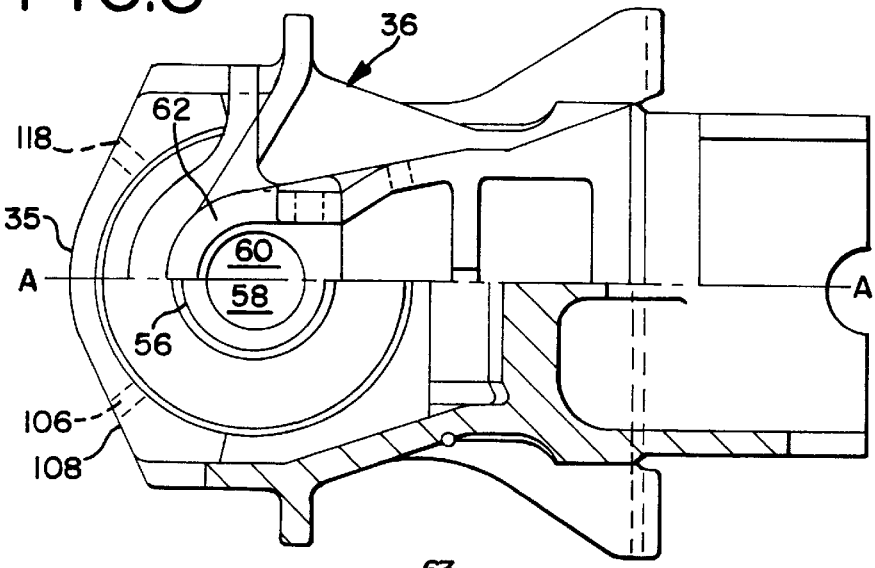
FIG. 5 is a plan view in partial section showing the female connector of FIG. 2.
Figure 6:
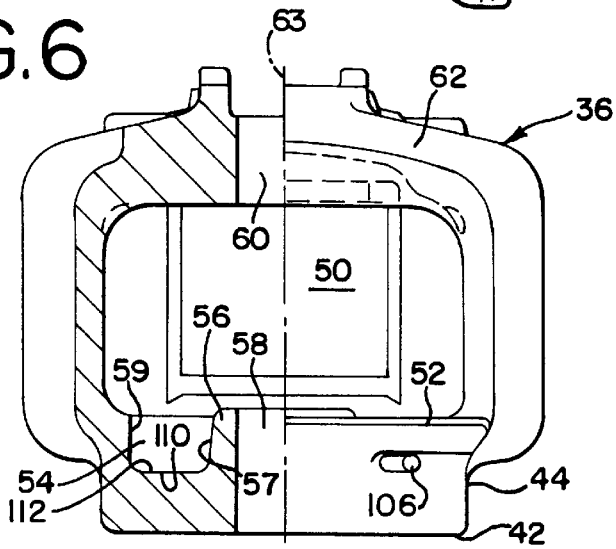
FIG. 6 is an elevational end view in partial section of the female connector of FIG. 2.

Articulated connector 26 is shown in FIGS. 2 to 4 and includes male connecting member 32 with rear or outer end 33 secured to inner end 22 of first railcar body 12 and front end 34 positioned in open front end 35 of improved female connecting member 36. Second railcar body inner end 24 is secured to rear or outer end 38 of female connecting member 36. Male connecting member front end 34 includes vertical pin aperture 40. Female connecting member bottom 42 has center plate bearing surface 44, which forms the insertion portion of a center plate joint 46. A corresponding center bowl 48 of center plate joint 46 is formed as part of bolster 28 of railcar truck 30 and is operable to receive center plate bearing surface 44 therein.

Front end 35 of female connecting member 36 is open to inner cavity 50. Bottom bounding surface 52 of cavity 50 has annular groove 54 positioned about circular hub 56. Annular groove 54 has floor 112, inner raised sidewall 57 and outer raised sidewall 59.

Vertical aperture 58 with vertical axis 63 extends through hub 56 and center plate bearing surface 44. Aperture 58 is alignable with second vertical aperture 60 extending through top portion 62 of female member open front end 35. Vertical primary pin 64 extends through apertures 58 and 60 and through aperture 40 of male member 32 to form a movable joint 66 between male member 32 and female member 36. The lower end of primary pin 64 has cylindrical cutout 67 to receive an upper end of center pin 68, which has its lower end extending into center bowl 48 of center plate joint 46 on bolster 28. Primary pin 64 is secured against vertical movement by horizontal retaining pin 69 in throughbore 70 at the top portion of female member 36. Retaining pin 69 passes through annular notch 72 in the perimeter of primary pin 64, which permits rotation of pin 64 while preventing unintentional removal or displacement of pin 64.

Movement between male member 32 and female member 36 is partially regulated by pin bearing block 74, which is positioned in male-member aperture 40 between primary pin 64 and end wall 76 of male-member rear outer end 34. Surface 78 of pin-bearing block 74 abutting end wall 76 is convex-shaped to correspond to concave-shaped surface 80 of end wall 76. The corresponding shaped surfaces provide for vertical angling movement of male member 32 relative to female member 36.

Male member 32 movement relative to female member 36 is also partially regulated by follower 82 and wedge shim 84, which are located between end wall 76 of male member 32 and innermost surface 86 of inner cavity 50 of female member 36. Abutting end wall 76 is surface 88 of follower 82, which surface 88 is concave-shaped to correspond to convex-shaped surface 90 of end wall 76. The respective correspondingly shaped surfaces provide for both horizontal and vertical angling movement of male member 32 relative to female member 36. Wedge shim 84 provides for a slack-free connection. Thus, as in-service wear of the male to female member connection occurs, end wall 76 of male member 32 tends to move away from surface 86 of female-member inner cavity 50. As a result of the wear, wedge shim 84 drops to reduce the slack.

Further, regulation of the movement between male member 32 and female member 36 is provided by ring seat 94 and spherical ring 92, which has an outer bottom radiused surface 96 complementary to outer top radiused surface 98 on spherical ring seat 94. The complementary radiused surfaces 96 and 98 provide for horizontal and vertical angling movement as well as rotational movement between male member 32 and female member 36. Spherical ring 92 and ring seat 94 are received within annular groove 54 about hub 56 in female connecting member 36. Undersurface 110 of spherical ring seat 94 is nested against floor 112 of annular groove 54. Top surface 100 of ring 92 engages flat undersurface 102 formed about aperture 40 in male member 32.

Figure 7:
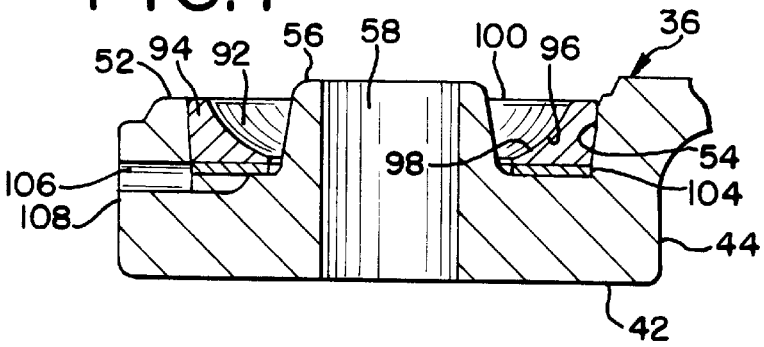
FIG. 7 is an enlarged partial elevational side view in section of the female connecting member of FIG. 2 with a shim under the ring seat.
Figure 8:
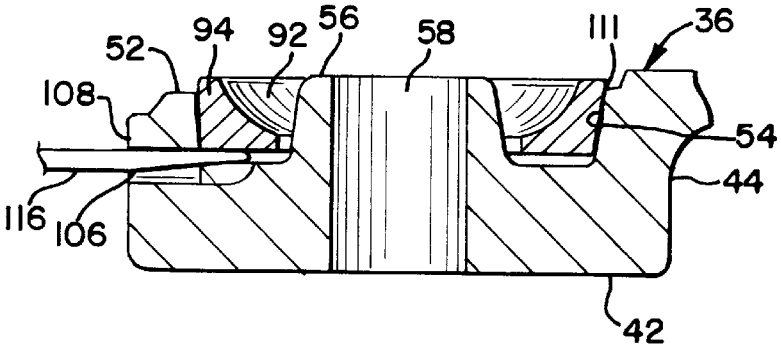
FIG. 8 is an enlarged partial elevational side view in section of the female connecting member of FIG. 2 with a wedge or lever bar in the access port and contacting the underside of the ring seat.

During railcar service, erosion occurs between contacting surfaces 100 and 102, and 96 and 98, which lowers male connecting member 32 and, consequently, car body 12. A further consequence is a corresponding decrease in the restrictive space allocated for clearance of side bearings (not shown) below the minimum standard set by the AAR. A method of restoration of male member 32 to an acceptacle height is by the placement of an annular shim 104 within annular groove 54 below undersurface 110, as in FIG. 7. Placement of shim 104 is accommodated by disconnecting male member 32 from female member 36; lifting spherical ring 92 and ring seat 94 from annular groove 54; inserting shim 104 and replacing spherical ring 92 and ring seat 94 on shim 104. Dislodging and removal of spherical ring seat 94 from annular groove 54 is often difficult as ring seat 94 may wear into groove 54 during usage, and, accumulated lubricant may solidify in the coupling along with dirt and debris between outer perimeter 111 of ring seat 94 and outer wall 59 of annular groove 54.

The height of the railcar and male member 32 may be restored by ejecting spherical ring seat 94 from annular groove 54, which is facilitated by applying an upward force against undersurface 110 from one or more locations outward of female member 36 after removal of male member 32, and this was recognized in U.S. Pat. No. 5,014,626. The concept is to apply an upward mechanical force to spherical ring seat 94 to dislodge and overcome any physical impediments to removal of spherical ring seat 94 from groove 54.

The above-noted force may be applied by a first tool 116 with a shaft 117 and a shaft outer surface 115 inserted through access passageway 106, which extends between exterior surface 108 of female member 36 and a point 119 along floor 112 approximately one-half of the distance of groove 54 between outer groove wall 59 and inner groove wall 57. Access passageway 106 has access lower wall 121 and upper wall 123, and in FIG. 10 a diameter 127. In this FIG. 10, the distance 'x' between access lower wall 121 and groove floor 112 is about one-half of diameter 127. Therefore, as noted in FIG. 10, lower shoulder 129 of ring seat 94 protrudes into passageway 106, but is displaced above lower wall 121 by the half-diameter distance or gap x. In this embodiment, tool 116 with tapered head 131, top edge 133 and lower edge 135 is insertable in passageway 106 with lower edge 135 sliding along lower wall 121 to insert leading edge 137 in gap x below undersurface 110. In this configuration, tool 116 can be forcibly driven into gap x, if required, with taper 131 contacting shoulder 129. After tool 116 is positioned below ring-seat undersurface 110, a downward force may be applied to upper edge 133 to use lower wall 121 as a fulcrum to pry ring seat 94 and ring 92 upward from groove 54.

An apparatus for performing the above-noted technique is tool 116 with forward or leading edge 137 insertable into passage 106 and under ring seat 94. Tool 116 extends between exterior surface 108 of female member 36 and at least outer wall 59 of groove 54. It is clear that tool 116 must be positioned under ring seat 94, and thus passageway 106 must be positioned in a region where it will extend beneath a portion of groove 54 normally covered by ring seat 94. Additionally, it would be convenient and helpful to position passageway 106 in a region of exterior surface 108 above the portion inserted within center bowl 48. This would expose passage 106 to insertion of tool 116 and the application of the mechanical force to tool 116 without removal of female member 36 from center bowl 48, that is "detrucking" is not necessary. The ejecting means includes one or more passageways 106 extending from exterior surface 108 of center plate 44 to at least outer wall 59 of groove 54 and tool or prying means 116. Access passageway 106 is most conveniently located at front open end 35 of female member 36, which becomes fully exposed upon removal of male member 32.

Figure 10:
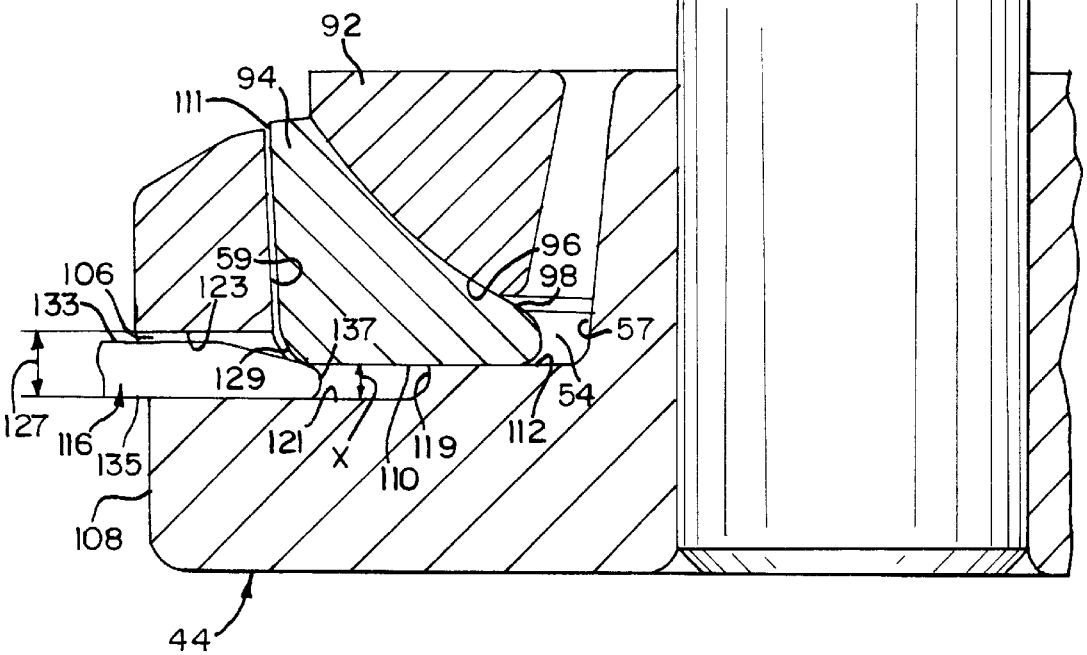
FIG. 10 is a cross-sectional view of the improved access-port and ring seat arrangement with a contacting tool head and ring-seat.

Disconnecting male member 32 from female member 36 exposes spherical ring 92 and ring seat 94, which allows for their ejection from annular groove 54 by insertion of tool 116 into passageway 106. In the illustration of FIG. 10, tool 116 appears as a chisel-like tool with leading edge 137 extending into passageway 106 and under spherical ring seat 94 to contact shoulder 129 with taper 131. Thereafter, tool 116 could be forcibly further driven into passageway 106 to force spherical ring seat 94 upward. Alternatively, a downward force could be applied to tool 116 outside of passageway 106 to use lower wall 121 and shaft 117 as a fulcrum and lever to upwardly pry and eject spherical ring seat 94.

Although access passageway 106 may be positioned anywhere around female member 36, it is preferred that passageway 106 be located in front exterior surface 108 of female connector 36° at a 45° angle radially displaced from the longitudinal centerline A—A of railcars 12 and 13. This preferred location passageway 106 should be directed through the center of hub 58. The second access passageway 118 may also preferably be located in front exterior surface 108 of female member 36° at a 45° angle radially displaced from longitudinal centerline A—A but on the opposite side of centerline A—A from passageway 106. In this fashion, second passageway 118 provides an access for insertion of another tool 116 (not shown), if required, to dislodge spherical ring seat 94 from annular groove 54. Also, second passageway 118 provides an alternative insertion point for tool 116 where access is desired from either side of centerline A—A.

Figure 9:
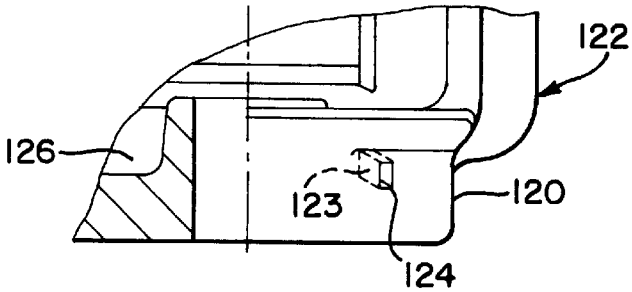
FIG. 9 is a partial elevational view of a female connecting member with the access passage noted in rectangular cross-section.
Figure 11:
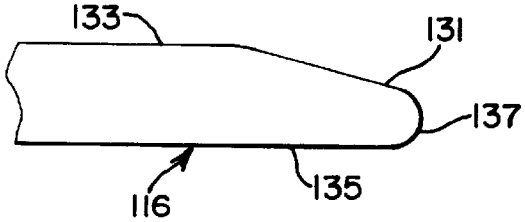
FIG. 11 is an illustration of a tool head for prying the ring seat from the female connector annular groove; and, FIG. 12 is a cross-sectional illustration of an alternative embodiment tool and ring seat arrangement for removal of a ring seat.

The preferred embodiment of the present invention, which is noted in FIGS. 2 through 8 and 10, includes a passageway 106 with a circular or ovular cross-section. However, this shape is not a limitation, but merely an illustration. Indicative of an alternative embodiment or passageway structure is the oblong or rectangular endview of passageway 106 noted in FIG. 9. In this embodiment, lower wall 121 would have a broader surface to engage a flat chisel-like tool lower edge or surface 135, which might also aid in insertion of leading edge 137 below spherical ring seat 94. Thus, the rectangular shape for passageway 106 may be preferred for a similarly shaped tool 116.

Figure 12:
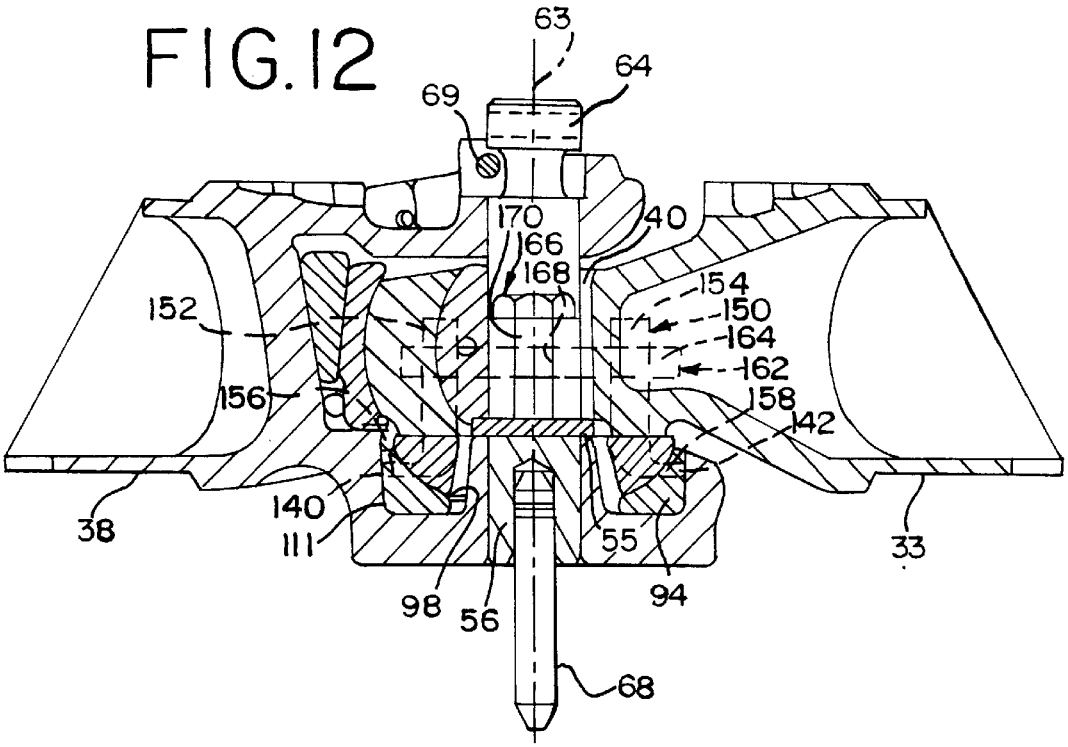

In an alternative embodiment in FIG. 12, ring seat 94 is provided with horizontal slots 140 and 142 radially outwardly extending from outer top radiused surface 98. Slots 140, 142 may extend through ring seat 94 from radiused surface 98 to outer perimeter 111, which slots 140, 142 are shown as diametrically opposed in the illustration.

In this embodiment, second tool 150 with L-shaped arms 152 and 154 is utilized to dislodge ring seat 94. Arms 152, 154 include fingers or protuberances 156 and 158, respectively, which fingers 156, 158 extend into slots 140, 142. Plate 160 is positioned on upper surface 55 of hub 56 after removal of primary pin 64 from apertures 40 and 58. Fixture 162 includes upper plate 164 with arms 152 and 154 extending therefrom and threaded screw 166 mated with central passage 168. Shaft 170 extends to contact plate 160 in the operable mode for removal of ring seat 94. In operation, shaft 170 is in contact with plate 160 and, arms 152 and 154 are in passages 140 and 142, respectively. As screw 166 is downwardly threaded against plate 160, plate 164, and thus arms 152, 154, are mechanically driven upwards to withdraw ring seat 94 with a relatively uniform mechanical force applied to diametrically opposite sides of ring seat 94.

While only specific embodiments of the invention have been described and shown, it is apparent that various alterations and modifications can be made therein. It is, therefore, the intention in the appended claims to cover all such modifications and alterations as may fall within the scope and spirit on the invention.

We claim:

1. An improved method of removing a ring seat from an annular groove of a female connecting member in an articulated connection for joining adjacent railcars, said groove having a floor, said female member having an open end, an exterior surface and an access passageway with a wall extending between said exterior surface and said annular groove, said access passageway being generally horizontal with an opening at said exterior surface and having a vertical height at said opening, said ring seat having a top surface and an undersurface nested on said groove floor, said ring-seat top surface providing support for a supporting spherical ring for a male connecting member of said articulated connection received in said female-member open end, said ring-seat removal method comprising:

removing said male connecting member and said supporting spherical ring from said female member and ring seat;

providing approximately one-half of said vertical height of said passageway below said ring-seat undersurface and below said groove floor in said annular groove with at least a horizontal portion of said passageway extending into said groove floor;

providing a tool with a shaft, a forward edge and a lower surface;

inserting said tool in said passageway with at least said tool forward edge contacting said ring-seat in proximity to said undersurface;

applying a force to said tool shaft to move said tool under said ring seat in proximity to said undersurface to eject said ring seat from said annular groove.

2. The method of removing a ring seat from an annular groove as claimed in claim 1 wherein said annular groove has an inner surface and an outer surface, said groove inner surface and outer surface cooperating to define a floor width therebetween, said ring-seat undersurface having a second width, said floor width is at least equal to the width of said second width, said method further comprising providing said passageway with a length from said female member exterior surface to at least said groove, extending said passageway length under said ring seat at least one-half of said second width, and inserting said forward edge of said tool under said groove and ring seat.

3. In an articulated connection for joining adjacent railcars, each said railcar having a first end and a second end, said articulated connection having a male connecting member and a female connecting member with an exterior surface, said male connecting member secured to one of said first end and second end of one of said adjacent railcars and said female member secured to one of said first end and second end of the other of said adjacent railcars, said female member having an open end and an annular groove with an inner surface, an outer surface and a floor, said groove inner surface and outer surface cooperating to define a first width therebetween, a ring seat positioned in said groove, said ring seat having a top surface and an undersurface contacting said floor, a supporting spherical ring positioned on said ring-seat top surface, means for ejecting said ring seat from said female member, said male member received in the open end of said female member to nest on and be supported by said spherical ring on said ring seat in said annular groove while allowing horizontal and vertical movement between said male and female members, said means for ejecting said ring seat comprising:

at least one access passageway in said female member, said passageway having a first end and a second end, said passageway first end open at said female member exterior surface, said passageway second end horizontally located directly below said groove floor and open to said undersurface at least one-half the distance of said first width at a position covered by said ring seat, a tool matable with said passageway, said passageway providing access for insertion of said tool beneath said ring seat to apply sufficient force to eject said ring seat from said annular groove.

4. The means for ejecting as claimed in claim 3, wherein said tool has a shaft with an outer wall and a forward end, which forward end is tapered from said forward end to said shaft outer wall to provide said tapered surface in said passageway beneath said ring seat.

* * * * *